US010063989B2

(12) United States Patent
Gorzel et al.

(10) Patent No.: US 10,063,989 B2
(45) Date of Patent: Aug. 28, 2018

(54) VIRTUAL SOUND SYSTEMS AND METHODS

(71) Applicant: Google Inc., Mountain View, CA (US)

(72) Inventors: Marcin Gorzel, Dublin (IE); Frank Boland, Dublin (IE); Brian O'Toole, Dublin (IE); Ian Kelly, Dublin (IE)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 14/937,647

(22) Filed: Nov. 10, 2015

(65) Prior Publication Data

US 2016/0134987 A1 May 12, 2016

Related U.S. Application Data

(60) Provisional application No. 62/078,050, filed on Nov. 11, 2014.

(51) Int. Cl.

| | |
|---|---|
| ***H04R 5/02*** | (2006.01) |
| ***H04S 7/00*** | (2006.01) |
| *H04R 5/00* | (2006.01) |

(52) U.S. Cl.

CPC ..... *H04S 7/304* (2013.01); *H04S 2400/11* (2013.01); *H04S 2420/01* (2013.01); *H04S 2420/11* (2013.01)

(58) Field of Classification Search

CPC .. H04S 7/304; H04S 2400/15; H04S 2420/01; H04S 3/00; H04S 2400/01;

(Continued)

(56) References Cited

U.S. PATENT DOCUMENTS 6,421,446 B1 * 7/2002 Cashion ..... H04S 1/005 381/17
2010/0303246 A1 * 12/2010 Walsh ..... H04S 3/00 381/18

(Continued)

FOREIGN PATENT DOCUMENTS

CN 106537941 A1 3/2017
EP 2 645 748 A1 10/2013

(Continued)

OTHER PUBLICATIONS

ISR & Written Opinion, dated Jan. 20, 2016, in related application No. PCT/2015/059911.

(Continued)

*Primary Examiner* — Norman Yu
(74) *Attorney, Agent, or Firm* — Brake Hughes Bellermann LLP

(57) ABSTRACT

Provided are methods and systems for updating a sound field in response to user movement. The methods and systems are less computationally expensive than existing approaches for updating a sound field, and are also suitable for use with arbitrary loudspeaker configurations. The methods and systems provide a dynamic binaural sound field rendering realized with the use of "virtual loudspeakers." Rather than loudspeaker signals being fed into the physical loudspeakers, the signals are instead filtered with left and right HRIRs (Head Related Impulse Response) corresponding to the spatial locations of these loudspeakers. The sums of the left and right ear signals are then fed into the audio output device of the user.

18 Claims, 12 Drawing Sheets

(58) Field of Classification Search
CPC ..... H04S 2420/11; H04S 3/004; H04S 7/30; H04S 1/00; H04S 1/002; H04S 1/005; H04S 2400/11; H04S 2420/13; H04S 5/00; H04S 7/00; H04S 7/303; H04R 5/027; H04R 2201/401; H04R 2420/07
USPC ..... 381/17, 310, 107, 18, 22, 23, 74
See application file for complete search history.

(56) References Cited

U.S. PATENT DOCUMENTS

| | | | | |
|---|---|---|---|---|
| 2011/0316967 | A1* | 12/2011 | Etter | H04N 7/142<br>348/14.16 |
| 2014/0219455 | A1 | 8/2014 | Peters et al. | |
| 2015/0326972 | A1* | 11/2015 | Barton | H04R 3/04<br>381/98 |

FOREIGN PATENT DOCUMENTS

| | | | |
|---|---|---|---|
| EP | 3141002 | A1 | 3/2017 |
| WO | WO 99/51063 | A1 | 10/1999 |
| WO | WO 2014/001478 | * | 1/2014 |
| WO | WO 2014/001478 | A1 | 1/2014 |
| WO | 2016/077317 | A1 | 5/2016 |

OTHER PUBLICATIONS

International Preliminary Report on Patentability for PCT Application No. PCT/US2015/059911, dated May 26, 2017, 9 pages.
Office Action for EP Application No. 15797561.6, dated Nov. 15, 2017, 4 pages.

* cited by examiner

VIRTUAL SOUND SYSTEMS AND METHODS

The present application claims priority to U.S. Provisional Patent Application Ser. No. 62/078,050, filed Nov. 11, 2014, the entire disclosure of which is hereby incorporated by reference.

BACKGROUND

In many situations it is desirable to generate a sound field that includes information relating to the location of signal sources (which may be virtual sources) within the sound field. Such information results in a listener perceiving a signal to originate from the location of the virtual source, that is, the signal is perceived to originate from a position in 3-dimensional space relative to the position of the listener. For example, the audio accompanying a film may be output in surround sound in order to provide a more immersive, realistic experience for the viewer. A further example occurs in the context of computer games, where audio signals output to the user include spatial information so that the user perceives the audio to come, not from a speaker, but from a (virtual) location in 3-dimensional space.

The sound field containing spatial information may be delivered to a user, for example, using headphone speakers through which binaural signals are received. The binaural signals include sufficient information to recreate a virtual sound field encompassing one or more virtual signal sources. In such a situation, head movements of the user need to be accounted for in order to maintain a stable sound field in order to, for example, preserve a relationship (e.g., synchronization, coincidence, etc.) of audio and video. Failure to maintain a stable sound or audio field might, for example, result in the user perceiving a virtual source, such as a car, to fly into the air in response to the user ducking his or her head. Though more commonly, failure to account for head movements of a user causes the source location to be internalized within the user's head.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

The present disclosure generally relates to methods and systems for signal processing. More specifically, aspects of the present disclosure relate to processing audio signals containing spatial information.

One embodiment of the present disclosure relates to a method for updating a sound field, the method comprising: generating virtual loudspeakers for a plurality of physical loudspeakers by determining Head Related Impulse Responses (HRIRs) corresponding to spatial locations of the plurality of physical loudspeakers; stabilizing a spatial sound field using head-tracking data associated with a user and at least one panning function based on direct gain optimization; and providing the stabilized sound field to an audio output device associated with the user.

In another embodiment, stabilizing the spatial sound field in the method for updating a sound field includes applying a panning function to each of the virtual loudspeaker signal feeds.

In another embodiment, the method for updating a sound field further comprises computing gains for each of the signals of the plurality of physical loudspeakers, and storing the computed gains in a look-up table.

In yet another embodiment, the method for updating a sound field further comprises determining modified gains for the loudspeaker signals based on rotated sound field calculations resulting from detected movement of the user.

In still another embodiment, the audio output device of the user is a headphone device, and the method for updating a sound field further comprises obtaining the head-tracking data associated with the user from the headphone device.

In another embodiment, the method for updating a sound field further comprises combining each of the modified gains with a corresponding pair of HRIRs, and sending the combined gains and HRIRs to the audio output device of the user.

Another embodiment of the present disclosure relates to a system for updating a sound field, the system comprising at least one processor and a non-transitory computer-readable medium coupled to the at least one processor having instructions stored thereon that, when executed by the at least one processor, causes the at least one processor to: generate virtual loudspeakers for a plurality of physical loudspeakers by determining Head Related Impulse Responses (HRIRs) corresponding to spatial locations of the plurality of physical loudspeakers; stabilize a spatial sound field using head-tracking data associated with a user and a panning function based on direct gain optimization; and provide the stabilized sound field to an audio output device associated with the user.

In another embodiment, the at least one processor in the system for updating a sound field is further caused to apply a panning function to each of the virtual loudspeaker signal feeds.

In another embodiment, the at least one processor in the system for updating a sound field is further caused to compute gains for each of the signals of the plurality of physical loudspeakers, and store the computed gains in a look-up table.

In yet another embodiment, the at least one processor in the system for updating a sound field is further caused to determine modified gains for the loudspeaker signals based on rotated sound field calculations resulting from detected movement of the user.

In still another embodiment, the audio output device of the user is a headphone device, and the at least one processor in the system for updating a sound field is further caused to obtain the head-tracking data associated with the user from the headphone device.

In yet another embodiment, the at least one processor in the system for updating a sound field is further caused to combine each of the modified gains with a corresponding pair of HRIRs, and send the combined gains and HRIRs to the audio output device of the user.

Yet another embodiment of the present disclosure relates to a method of providing an audio signal including spatial information associated with a location of at least one virtual source in a sound field with respect to a position of a user, the method comprising: obtaining a first audio signal including a plurality of signal components, each of the signal components corresponding to a respective one of a plurality of virtual loudspeakers located in the sound field; obtaining an indication of user movement; determining a plurality of panned signal components by applying, based on the indication of user movement, a panning function of a respective order to each of the signal components, wherein the panning function utilizes a direct gain compensation function; and outputting to the user a second audio signal including the panned signal components.

In one or more embodiments, the methods and systems described herein may optionally include one or more of the following additional features: the modified gains for the loudspeaker signals are determined as a weighted sum of the original loudspeaker gains; the look-up table is psychoacoustically optimized for all panning angles based on objective criteria indicative of a quality of localization of sources; the audio output device of the user is a headphone device; the second audio signal including the panned signal components is output through a headphone device of the user; and/or the indication of user movement is obtained from the headphone device of the user.

Embodiments of some or all of the processor and memory systems disclosed herein may also be configured to perform some or all of the method embodiments disclosed above. Embodiments of some or all of the methods disclosed above may also be represented as instructions embodied on transitory or non-transitory processor-readable storage media such as optical or magnetic memory or represented as a propagated signal provided to a processor or data processing device via a communication network such as an Internet or telephone connection.

Further scope of applicability of the methods and systems of the present disclosure will become apparent from the Detailed Description given below. However, it should be understood that the Detailed Description and specific examples, while indicating embodiments of the methods and systems, are given by way of illustration only, since various changes and modifications within the spirit and scope of the concepts disclosed herein will become apparent to those skilled in the art from this Detailed Description.

BRIEF DESCRIPTION OF DRAWINGS

These and other objects, features, and characteristics of the present disclosure will become more apparent to those skilled in the art from a study of the following Detailed Description in conjunction with the appended claims and drawings, all of which form a part of this specification. In the drawings:

Figure 1A:
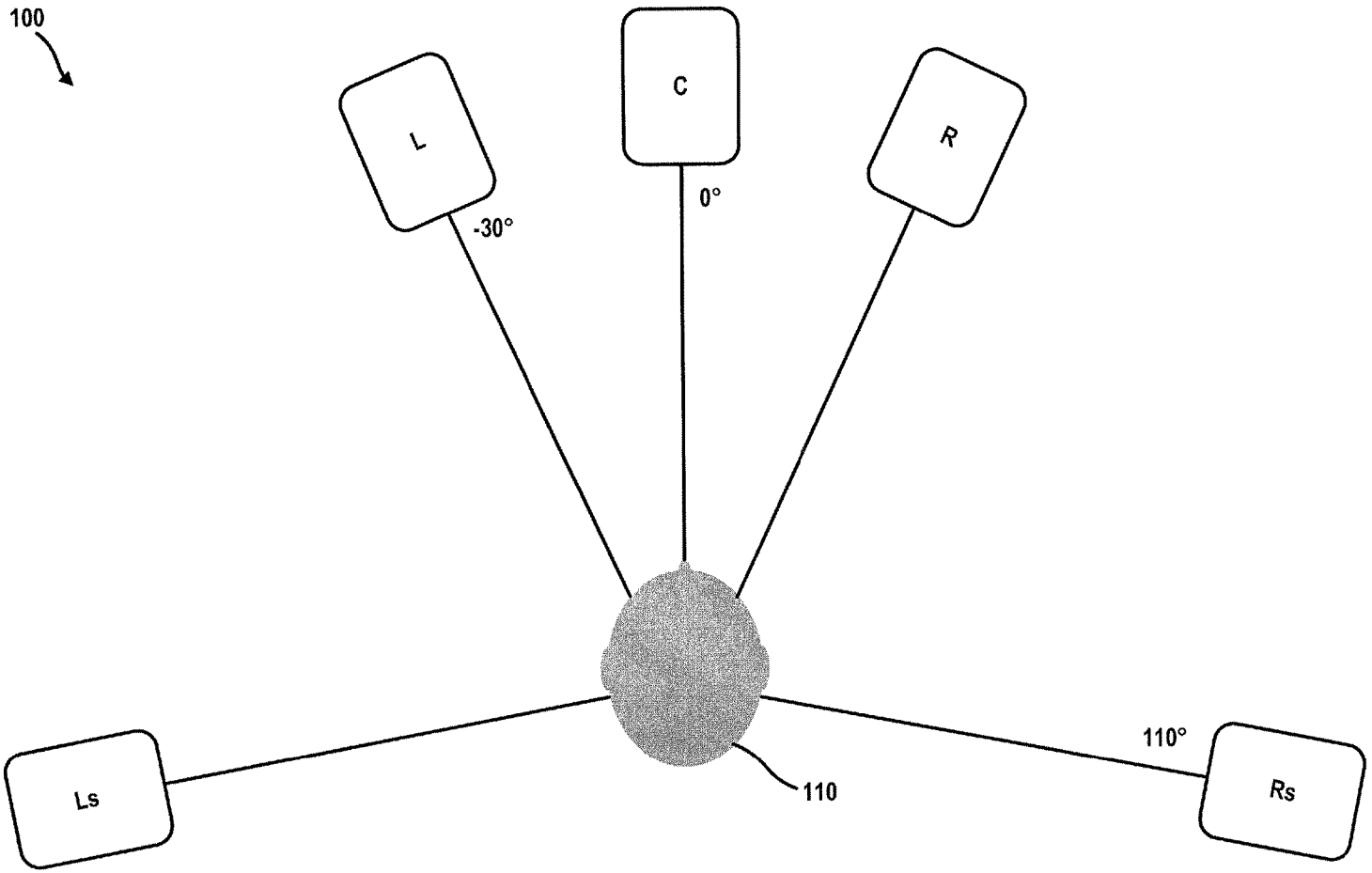
FIG. 1A is a block diagram illustrating an example system for virtual loudspeaker reproduction using measurements of HRIRs (Head Related Impulse Response) corresponding to spatial locations of all loudspeakers in a setup according to one or more embodiments described herein.

The headings provided herein are for convenience only and do not necessarily affect the scope or meaning of what is claimed in the present disclosure.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various examples and embodiments of the methods and systems of the present disclosure will now be described. The following description provides specific details for a thorough understanding and enabling description of these examples. One skilled in the relevant art will understand, however, that one or more embodiments described herein may be practiced without many of these details. Likewise, one skilled in the relevant art will also understand that one or more embodiments of the present disclosure can include other features not described in detail herein. Additionally, some well-known structures or functions may not be shown or described in detail below, so as to avoid unnecessarily obscuring the relevant description.

In addition to avoiding possible negative user experiences, such as those discussed above, maintenance of a stable sound field induces more effective externalization of the sound field or, put another way, more effectively creates the sense that the sound source is external to the listener's head and that the sound field includes sources localized at controlled locations. As such, it is clearly desirable to modify a generated sound field to compensate for user movement, such as, for example, rotation or movement of the user's head around x-, y-, and/or z-axis (when using the Cartesian system to represent space).

This problem can be addressed by detecting changes in head orientation using a head-tracking device and, whenever a change is detected, calculating a new location of the virtual source(s) relative to the user, and re-calculating the 3-dimensional sound field for the new virtual source locations. However, this approach is computationally expensive. Since most applications, such as computer game scenarios, involve multiple virtual sources, the high computational cost makes such an approach unfeasible. Furthermore, this approach makes it necessary to have access to both the original signal produced by each virtual source as well as the current spatial location of each virtual source, which may also result in an additional computational burden.

Existing solutions to the problem of rotating or panning the sound field in accordance with user movement include the use of amplitude panned sound sources. However, such existing approaches result in a sound field containing impaired distance cues as they neglect important signal characteristics such as direct-to-reverberant ratio, micro head movements, and acoustic parallax with incorrect wavefront curvature. Furthermore, these existing solutions also give impaired directional localization accuracy as they have to contend with sub-optimal speaker placements (e.g., 5.1 or 7.1 surround sound speaker systems, which have not been designed for gaming systems).

Maintaining a stable sound field strengthens the sense that the audio sources are external to the listener's head. The effectiveness of this process is technically challenging. One important factor that has been identified is that even small, unconscious head movements help to resolve front-back confusions. In binaural listening, this problem most frequently occurs when non-individualised HRTFs (Head Related Transfer Function) are used. Then, it is usually difficult to distinguish between the virtual sound sources at the front and at the back of the head.

Accordingly, embodiments of the present disclosure relate to methods and systems for updating a sound field in response to user movement. As will be described in greater detail below, the methods and systems of the present disclosure are less computationally expensive than existing approaches for updating a sound field, and are also suitable for use with arbitrary loudspeaker configurations.

In accordance with one or more embodiments described herein, the methods and systems provide a dynamic binaural sound field rendering realized with the use of "virtual loudspeakers". Rather than loudspeaker signals being fed into the physical loudspeakers, the signals are instead filtered with left and right HRIRs (Head Related Impulse Response) corresponding to the spatial locations of these loudspeakers. The sums of the left and right ear signals are then fed into the audio output device (e.g., headphones) of the user. For example, the following may utilized in order to obtain the left ear headphone feed:

$$L=\Sigma_{i=1}^{N} h_{L_i} * q_i \tag{1}$$

where * denotes convolution and $h_{Li}$ is the left ear HRIR corresponding to the ith loudspeaker location and $q_i$ is its signal feed. The process is analogical for the right ear signal feed.

In the virtual loudspeaker approach in accordance with one or more embodiments of the present disclosure, HRIRs are measured at the so-called "sweet spot" (e.g., a physical point in the center of the loudspeaker array where best localization accuracy is generally assured) so the usual limitations of, for example, stereophonic systems are thus mitigated.

Figure 1B:
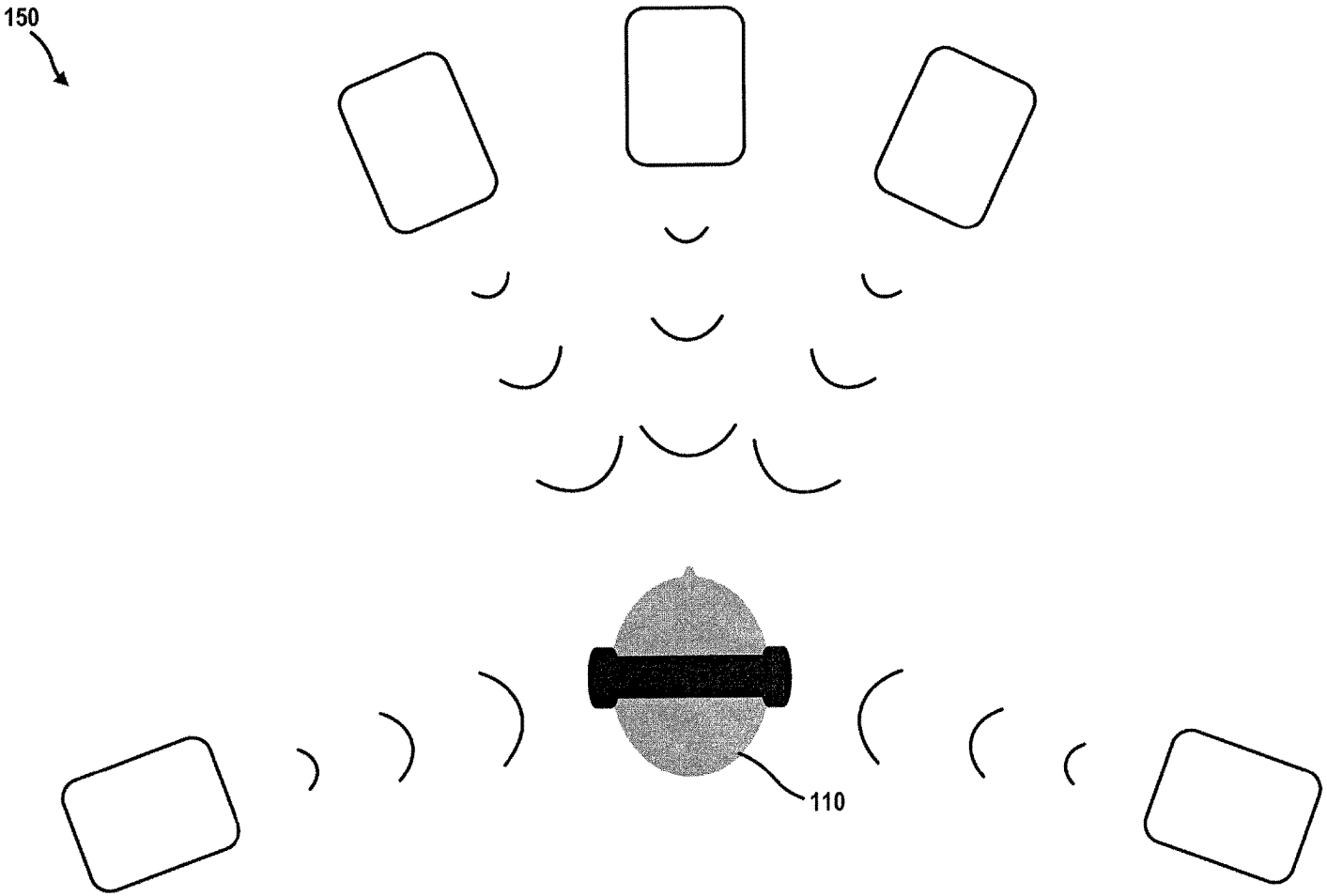
FIG. 1B is a block diagram illustrating an example system for playback of loudspeakers signals convolved with HRIRs according to one or more embodiments described herein.

FIGS. 1A and 1B illustrate an example of forming the virtual loudspeakers from the ITU 5.0 (it should be noted that 0.1 channel may be discarded since it does not convey spatial information) array of loudspeakers.

In particular, FIGS. 1A and 1B show an example virtual loudspeaker reproduction system and method (100, 150) whereby HRIRs corresponding to the spatial locations of all loudspeakers in a given setup are measured (FIG. 1A) and combined with the loudspeaker signals (e.g., forming a 2-channel binaural steam, as further described below) for playback to the user (FIG. 1B).

In practice, sound field stabilization means that the virtual loudspeakers need to be "relocated" in the 3-dimensional (3-D) sound field in order to counteract the user's head movements. However, it should be understood that this process is equivalent to applying panning functions to virtual loudspeaker feeds. In accordance with one or more embodiments of the present disclosure, a stabilization system is provided to apply the most optimal and also the most cost-effective panning solutions that can be used in the process of sound field stabilization with head-tracking.

Rotated sound field calculations result in new loudspeaker gain coefficients applied to the loudspeaker signals. These modified gains are derived as a weighted sum of all the original loudspeaker gains:

$$\begin{bmatrix} L' \\ R' \\ C' \\ Ls' \\ Rs' \end{bmatrix} = \begin{bmatrix} G_{1,1}(\Phi_H) & \dots & G_{1,5}(\Phi_H) \\ \vdots & \ddots & \vdots \\ G_{5,1}(\Phi_H) & \dots & G_{5,5}(\Phi_H) \end{bmatrix} \begin{bmatrix} L \\ R \\ C \\ Ls \\ Rs \end{bmatrix} \tag{2}$$

or simply $$g'=G(\Phi_H)g \tag{3}$$

where $[L, R, C, Ls, Rs]^T$ and $[L', R', C', Ls', Rs']^T$ are original and transformed 5.0 loudspeaker feeds due to head rotation by the angle $\Phi_H$. This operation can be seen as equivalent to applying a panning function $g_i(\varphi S)$ to each discrete loudspeaker feed. Additional details about processes for calculating matrices $G(\Phi_H)$ in accordance with one or more embodiments of the present disclosure are provided below.

Figure 2:
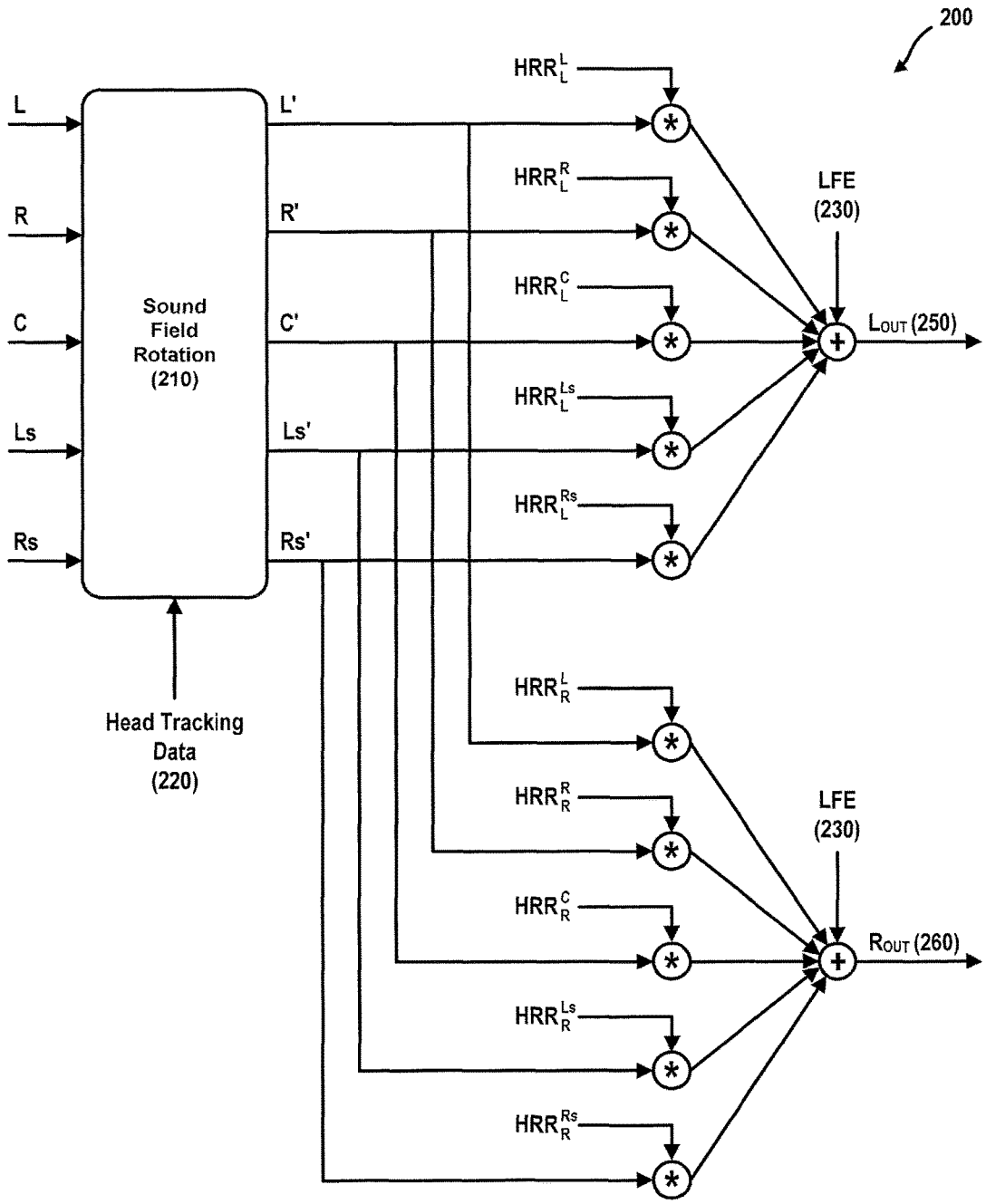
FIG. 2 is a block diagram illustrating an example system for combining loudspeaker signals with HRIR measurements corresponding to the spatial locations of the loudspeakers to forming a 2-channel binaural stream according to one or more embodiments described herein.

In order for the virtual loudspeakers to be applied to the rotated signals, each re-calculated loudspeaker gain needs to be convolved (e.g., combined) with the corresponding pair of HRIRs. FIG. 2 illustrates an example system 200 for combining loudspeaker signals with HRIR measurements corresponding to the spatial locations of a set of loudspeakers to form a 2-channel binaural stream ($L_{OUT}$ 250 and $R_{OUT}$ 260). In accordance with at least one embodiment, the example system and process (200) may be utilized with a 5-loudspeaker spatial array, and may include sound field rotation (210), which takes into account head tracking data (220), as well as low-frequency effects (LFE) 230 in forming binaural output for presentation to the user.

Sound Field Stabilization by Direct Gain Optimization

The following describes the process of computing gain coefficients of the matrix $G(\Phi_H)$ used in the system of the present disclosure. It should be noted that although the following description is based on the ITU 5.0 surround sound loudspeaker layout (with the "0.1" channel discarded), the methods and systems presented are expandable and adaptable for use with various other loudspeaker arrangements and layouts including, for example, 7.1, 9.1, and other regular and irregular arrangements and layouts.

The methods and systems of the present disclosure are based upon and utilize energy and velocity vector localization, which have proven to be useful in predicting the high and low frequency localization in multi-loudspeaker systems and have been used extensively as a tool in designing, for example, audio decoders. Vector directions are good predictors of perceived angles of low and mid-high frequency sources and the length of each vector is a good predictor of the "quality" or "goodness" of localization. Energy and velocity vectors are calculated for a given set of loudspeaker gains in a multichannel audio system. One can distinguish the vector's components in the x, y, and z directions, respectively. However, for the sake of simplicity, and to avoid obscuring the relevant features of the present disclosure, in the following example horizontal only reproduction is illustrated, so that the energy vector may be defined as:

$$e = [e_x \quad e_y] \tag{4}$$

$$e_x = \sum_{i=1}^{N} \frac{g_i^2 \cos(\Phi_i)}{P_e} \tag{5}$$

$$e_y = \sum_{i=1}^{N} \frac{g_i^2 \sin(\Phi_i)}{P_e} \tag{6}$$

$$P_e = \sum_{i=1}^{N} g_i \tag{7}$$

where $e_x$ and $e_y$ are the vector components in the x and y directions, respectively, N is the total number of loudspeakers in the array, and $g_i$ is the real gain of the ith loudspeaker located at the horizontal angle $\Phi_i$. The physical meaning of $P_e$ can be considered as a total energy of the system. The magnitude or norm of the energy vector, which may be defined as $$\|e\| = \sqrt{e_x^2 + e_y^2}, \tag{8}$$

can be thought of as the measure of energy concentration in a particular direction. The direction of the maximum energy concentration may be given by:

$$\phi_e = \arctan\left(\frac{e_y}{e_x}\right) = 2 \arctan\left(\frac{\|e\| - e_x}{e_y}\right). \tag{9}$$

Similarly, velocity vectors may be defined as:

$$v = [v_x \quad v_y] \tag{10}$$

$$v_x = \sum_{i=1}^{N} \frac{g_i^2 \cos(\Phi_i)}{P_v} \tag{11}$$

$$v_y = \sum_{i=1}^{N} \frac{g_i^2 \sin(\Phi_i)}{P_v} \tag{12}$$

$$P_v = \sum_{i=1}^{N} g_i \tag{13}$$

The magnitude or norm of the velocity vector, which may be defined as $$\|v\| = \sqrt{v_x^2 + v_y^2}, \tag{14}$$

can be thought of as a ratio of the net acoustic velocity from the N loudspeakers that simulate a sound source in the φS direction, and the velocity that would have resulted from the single sound source in this direction. It is important to note that while the sign of the gains squared in the energy vectors is always positive, in the velocity vectors the sign is preserved and can be negative as well. The practical implications of this fact are that the norm of the velocity vector can be adjusted by using out-of-phase loudspeakers "pulling" the pressure from the diametrically opposite direction. For physical sources, the magnitude of the velocity vector is always 1, but for a virtual source, because of the possible out-of-phase components, the magnitude of the velocity vector can be greater than 1.

The velocity vector direction, which may be defined as $$\phi_v = \arctan\left(\frac{v_y}{v_x}\right) = 2 \arctan\left(\frac{\|v\| - v_x}{v_y}\right), \tag{15}$$

simply indicates the net direction of air particle oscillations.

In accordance with one or more embodiments of the present disclosure, the systems and methods described may utilize a look-up table 726 with gain coefficients that are computed with an azimuthal resolution of, for example, one degree (1°). The use of the look-up table 726 is a simple and low-cost way of implementing head-tracking to the ITU 5.0-to-binaural mixdown. The gains in the look-up table 726 are psychoacoustically optimized for all the panning angles φS in order to satisfy various objective predictors of best quality localization. Such objective predictors may include, but are not limited to, the following:

(i) Energy vector length $\|r_e\|$ should be close to unity.

(ii) Velocity vector length $\|r_v\|$ should be close to unity.

(iii) Reproduced energy should be substantially independent of panning angle.

(iv) The velocity and energy vector directions $\varphi r_v$ and $\varphi r_e$ should be closely matched.

(v) The angle of the energy vectors $\varphi r_e$ should be reasonably close to the panning angle φS.

(vi) The angle of the velocity vectors $\varphi r_v$ should be reasonably close to the panning angle φS.

The example objectives (i)-(vi) described above may be expressed respectively as:

$$\|r_e\| \approx 1 \tag{i}$$

$$\|r_v\| \approx 1 \tag{ii}$$

$$P_e \approx 1 \tag{iii}$$

$$\varphi r_e \approx \varphi r_v \tag{iv}$$

$$\varphi r_e \approx \varphi S \tag{v}$$

$$\varphi r_v \approx \varphi S \tag{vi}$$

The optimization may be performed using non-linear unconstrained search for the minimum of the multivariable cost function $f(g)=g_2, g_3, g_4, g_5)$, where $g_i$ are the loudspeaker gains. The total cost function, being a sum of partial quadratic functions $f_k(g)$, is designed and analyzed symbolically, and reflects the example set of objectives (i)-(vi) as described above. The symbolic analysis is performed in order to derive the gradient of the cost function:

$$\nabla f(x_1, x_2, \ldots, x_n) = \left[\frac{\delta f}{\delta x_1}, \frac{\delta f}{\delta x_2}, \ldots, \frac{\delta f}{\delta x_n}\right]^T, \tag{16}$$

and its Hessian:

$$H(f(x_1, x_2, \ldots, x_n)) = J(\nabla f(x_1, x_2, \ldots, x_n)) \tag{17}$$

$$= \begin{bmatrix} \frac{\delta^2 f}{\delta x_1^2} & \frac{\delta^2 f}{\delta x_1 \delta x_2} & \cdots & \frac{\delta^2 f}{\delta x_1 \delta x_n} \\ \frac{\delta^2 f}{\delta x_2 \delta x_1} & \frac{\delta^2 f}{\delta x_2^2} & \cdots & \frac{\delta^2 f}{\delta x_2 \delta x_n} \\ \vdots & \vdots & \ddots & \vdots \\ \frac{\delta^2 f}{\delta x_n \delta x_1} & \frac{\delta^2 f}{\delta x_n \delta x_2} & \cdots & \frac{\delta^2 f}{\delta x_n^2} \end{bmatrix},$$

where $J(\xi(x))$ denotes the Jacobian of the function. This approach has the advantage that the gradient estimation by the means of finite differences is avoided and so is the risk of the numerical error, particularly in the estimation of the Hessian. The partial quadratic cost functions and the resultant total cost function are:

$$f_1(g)=(1-\|r_e\|)^2$$

$$f_2(g)=(1-\|r_v\|)^2$$

$$f_3(g)=(1-P_e)^2$$

$$f_4(g)=(\phi_{r_e}-\phi_{r_v})^2$$

$$f_5(g)=(\phi_{r_e}-\phi S)^2$$

$$f_6(g)=(\phi_{r_v}-\phi S)^2$$

$$f(g)=f_1(g)+f_2(g)+f_3(g)+f_4(g)+f_5(g)+f_6(g) \tag{18}$$

In accordance with at least one embodiment described herein, the process uses the above example partial quadratic cost functions with equal weightings, which is a compromise between the quality of localization for a broadband signal and ease of implementation (e.g., in game audio engines). In accordance with one or more other embodiments, the process may utilize different weighting schemes for the low- and mid- to high-frequency bands, where more weight is given to the $f_2(g)$ and $f_6(g)$ at low frequencies and more weight is given to $f_1(g)$ and $f_5(g)$ at mid and high frequencies. For this to happen, shelf filters can be employed in order to split the multichannel input into low and mid/high frequency streams.

Figure 3A:
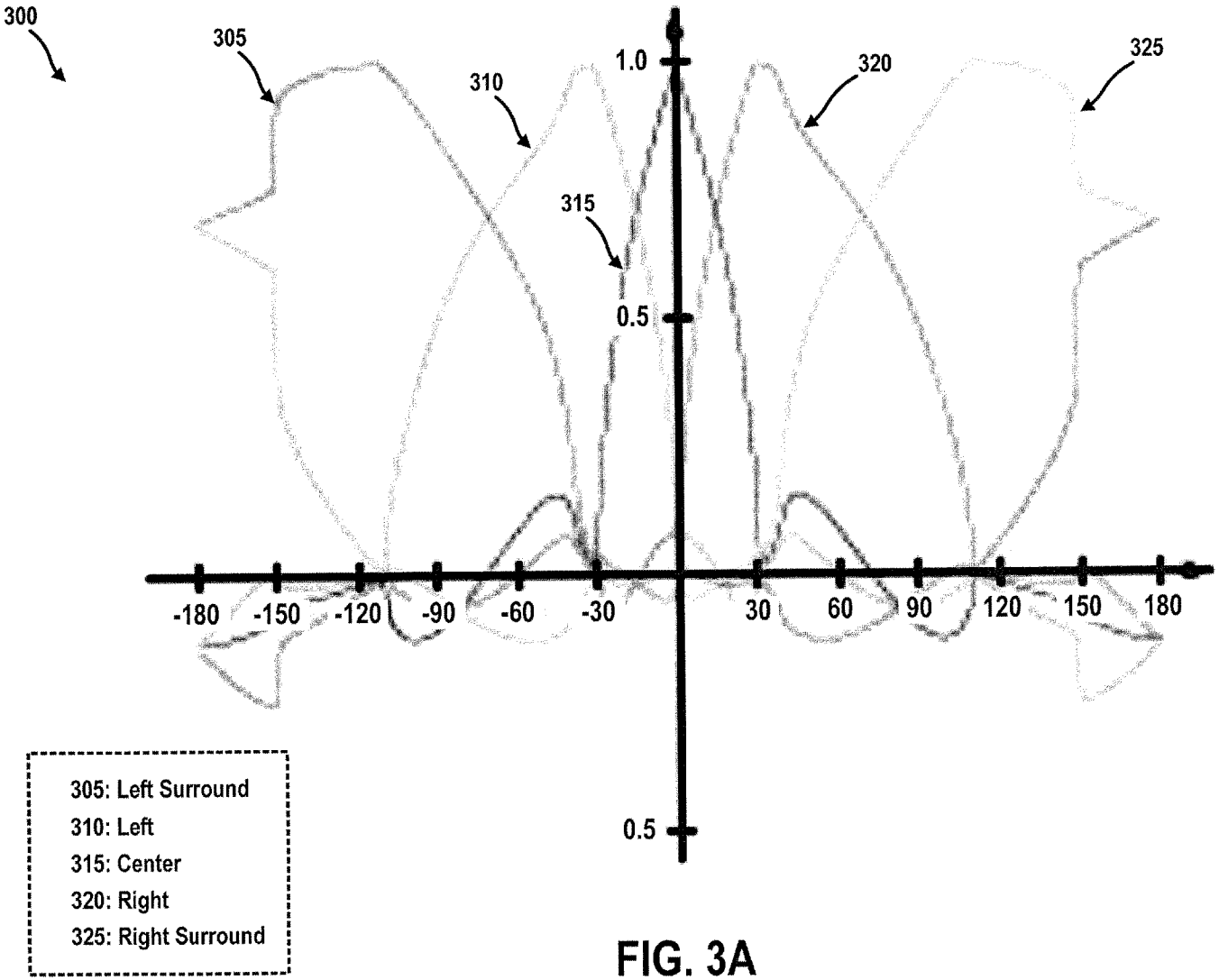
FIG. 3A is a graphical representation illustrating example gain functions for individual loudspeakers resulting from an example panning method at different panning angles according to one or more embodiments described herein.
Figure 3B:
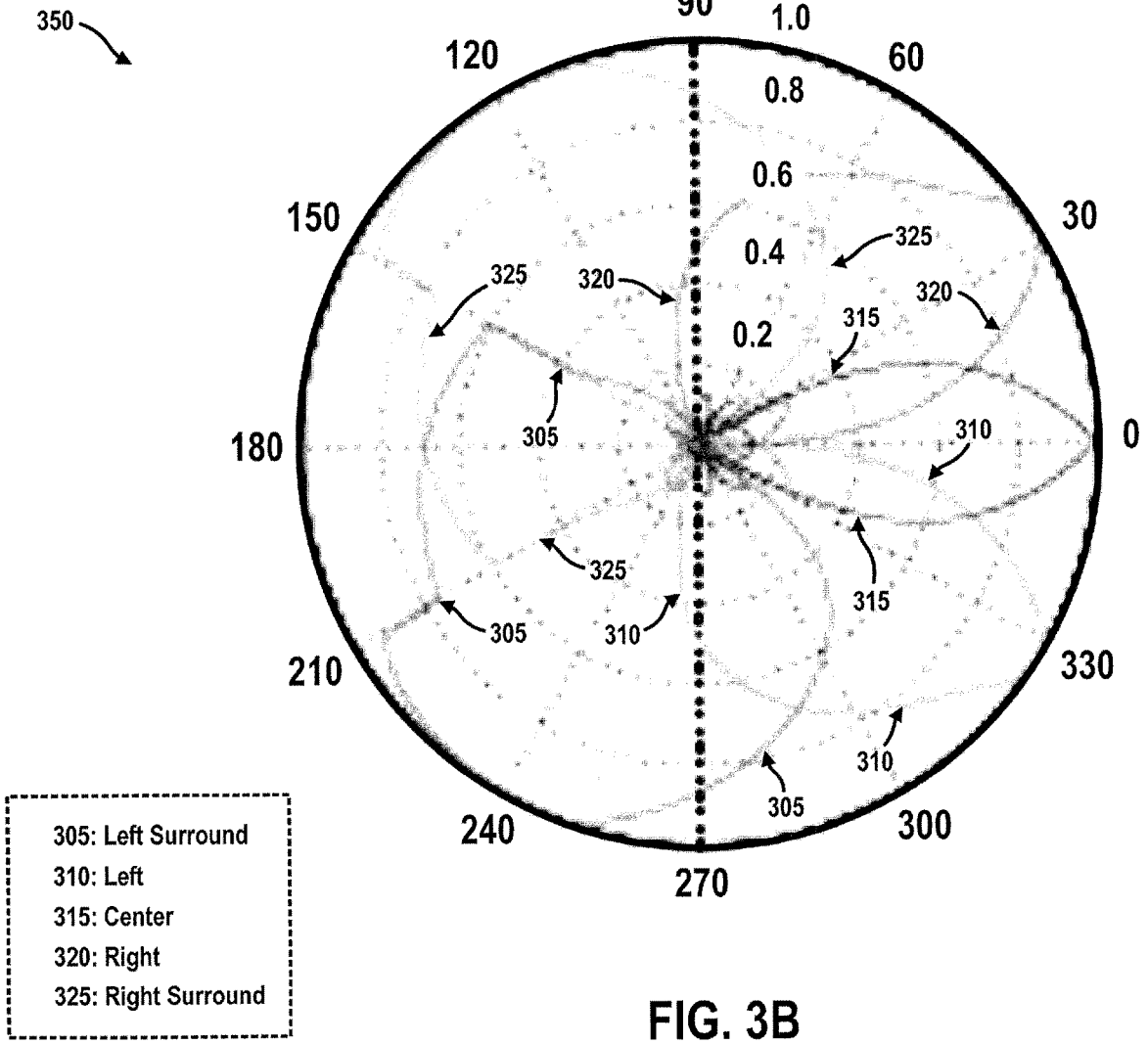
FIG. 3B is a graphical representation illustrating example gain functions for individual loudspeakers resulting from an example panning method at different panning angles according to one or more embodiments described herein.

FIGS. 3A and 3B show the gain functions $g_1(\varphi S)$ for individual loudspeakers resulting from the panning process described above at different panning angles, in accordance with one or more embodiments of the present disclosure.

To minimize the function the $f(g)$, the process may utilize, for example, a MATLAB routine $f_{minune}$ to perform a large-scale search for the minimum of the function in the vicinity of some initial guess. In one example of a MATLAB script routing, a script expects a 5×360 matrix as an input. In each column there are 5 loudspeaker gains that are used in order to position a sound source at a given angle.

It should be noted that in the process of optimization it is usually a good practice to choose the initial guess such that, for example, some of the parameters are already pre-optimized. In this vein, the Pairwise Constant Power Panning (PCPP) gain functions computed at one-degree (1°) increments are an example of a good candidate for use as a starting point for further optimization. Using PCPP gain functions as an initial estimate, the process may converge on a result after as few as seven iterations (on average).

Figure 4A:
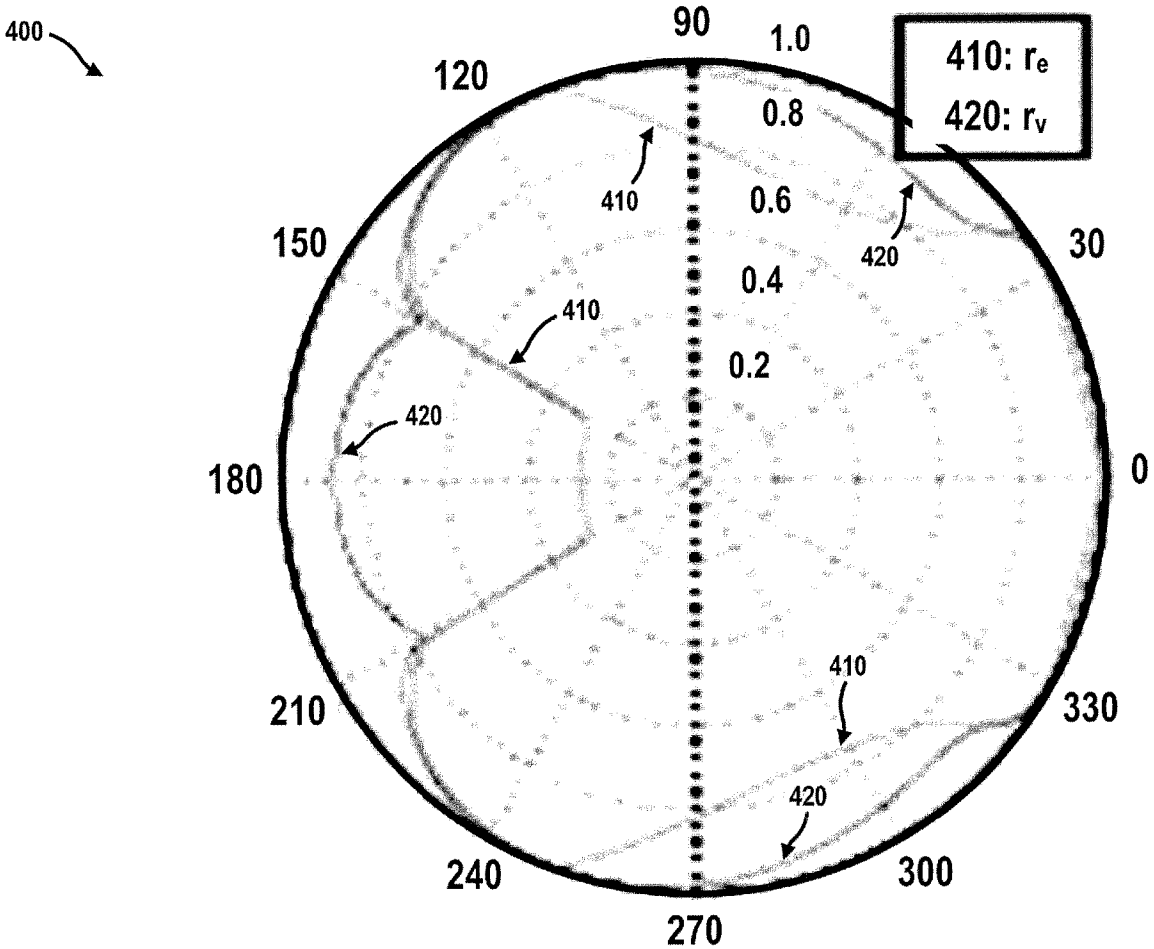
FIG. 4A is a graphical representation illustrating an example analysis of the magnitudes of energy and velocity vectors in the case of an example panning method according to one or more embodiments described herein.
Figure 4B:
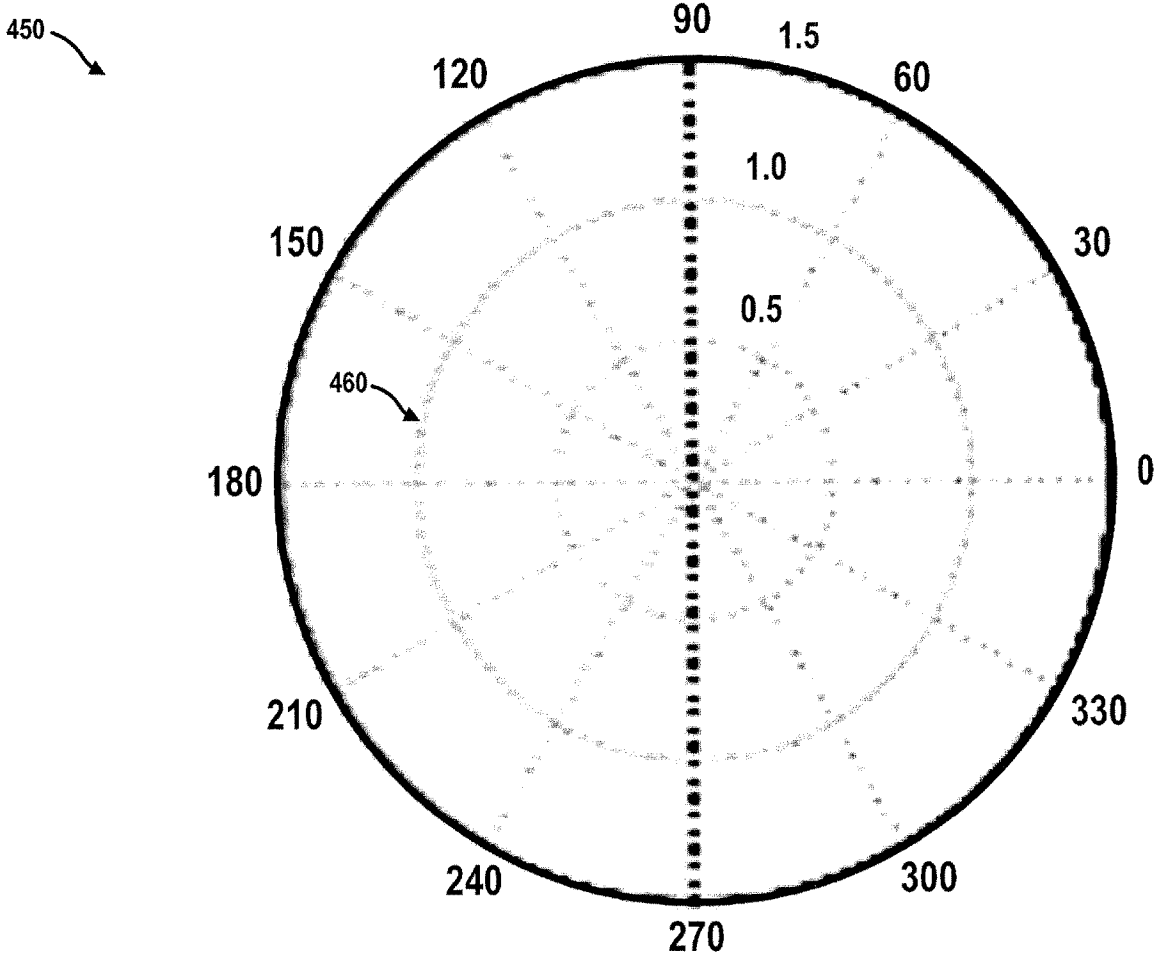
FIG. 4B is a graphical representation illustrating an example analysis of total emitted energy for different panning angles according to one or more embodiments described herein.

FIGS. 4A and 4B shows analyses of the magnitudes of energy and velocity vectors, and the total emitted energy $P_e$ for different panning angles in accordance with one or more embodiments of the methods and systems of the present disclosure.

Figure 5A:
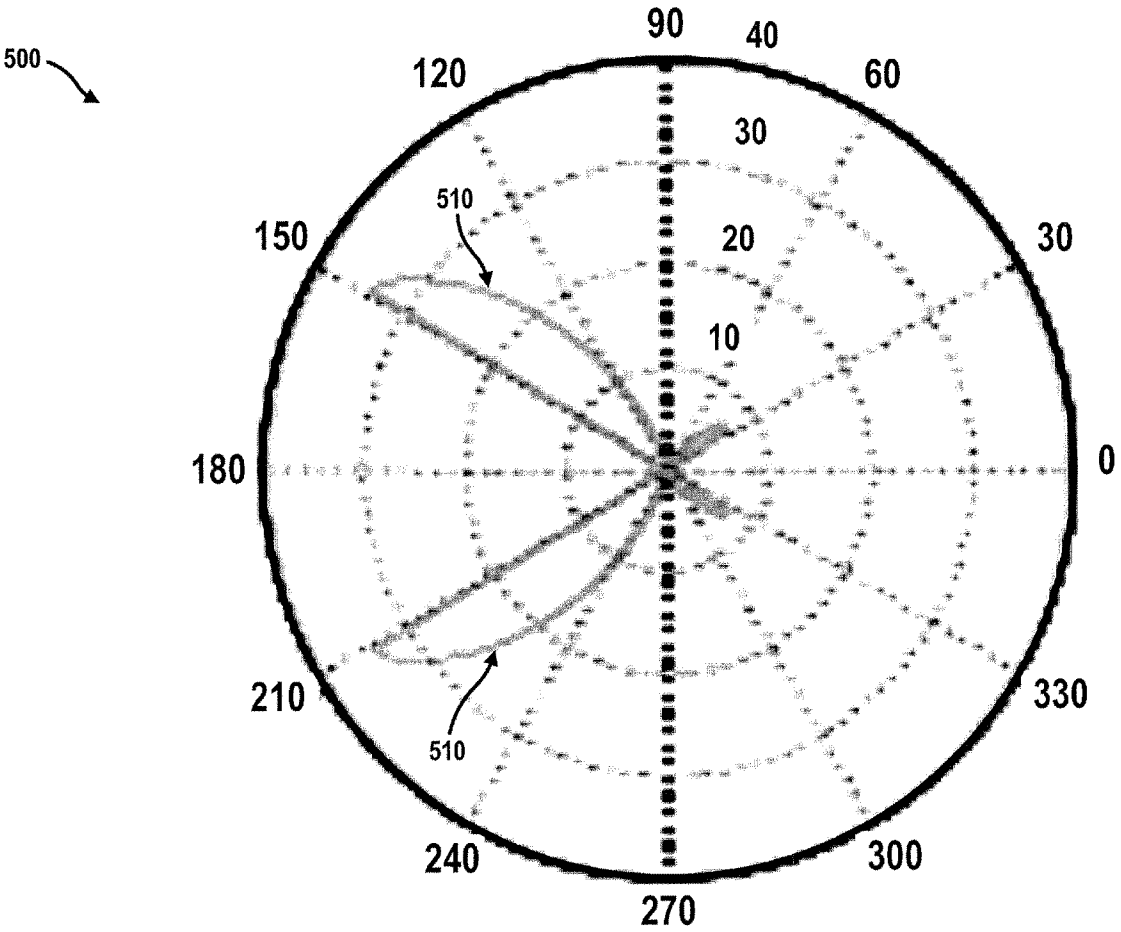
FIG. 5A is a graphical representation illustrating an example of the absolute difference in degrees between the energy vector direction and the intended panning angle according to one or more embodiments described herein.
Figure 5B:
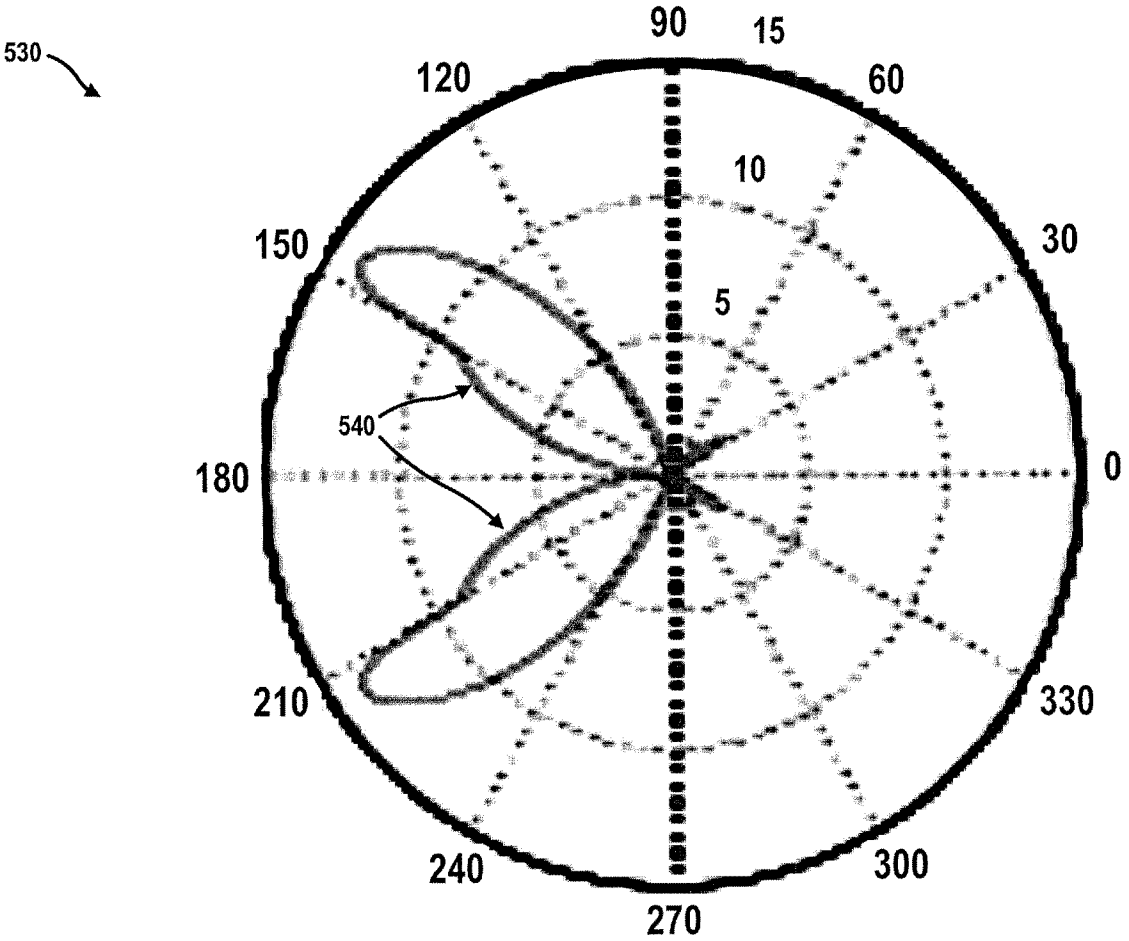
FIG. 5B is a graphical representation illustrating an example of the absolute difference in degrees between the velocity vector direction and the intended panning angle according to one or more embodiments described herein.
Figure 5C:
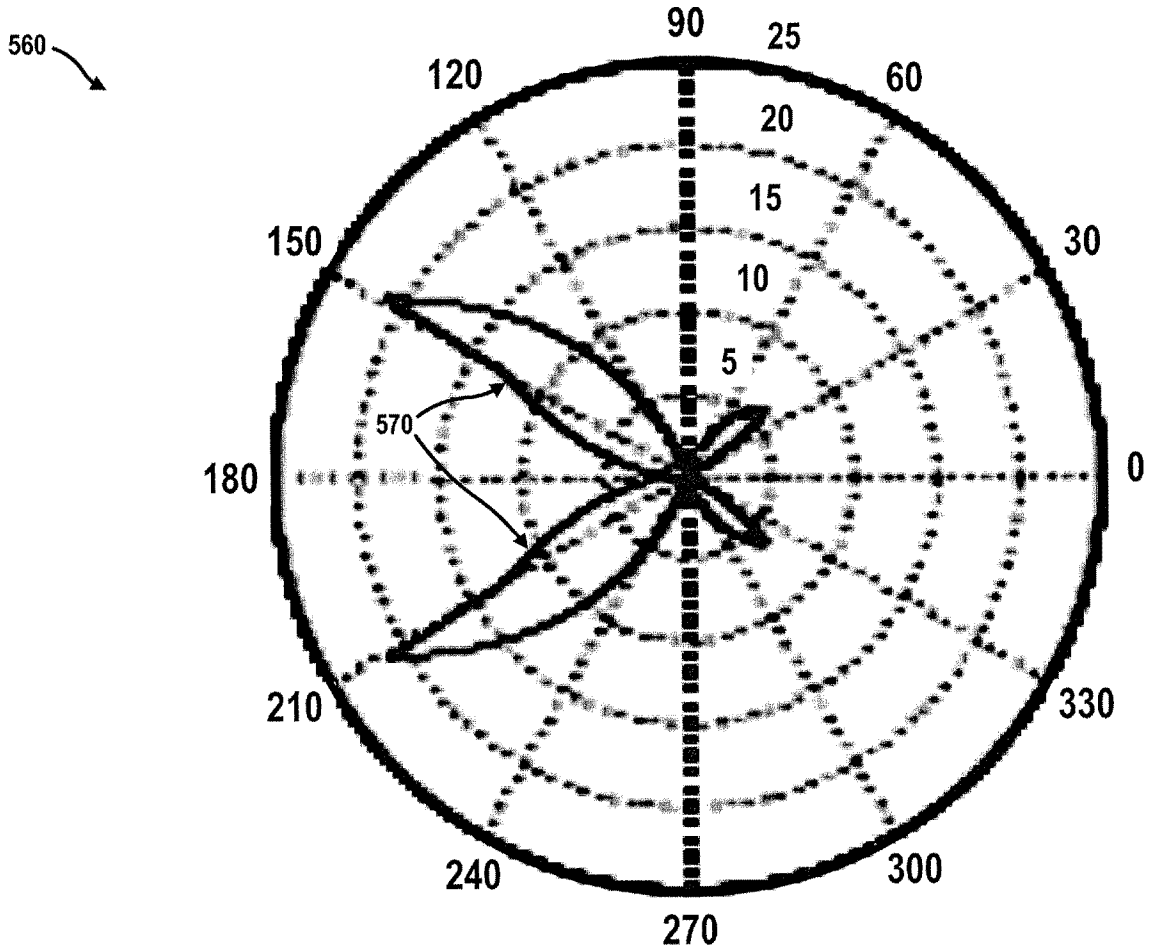
FIG. 5C is a graphical representation illustrating an example of the absolute difference in degrees between the energy vector direction and the velocity vector direction according to one or more embodiments described herein.

FIGS. 5A-5C are examples of the absolute difference (e.g., error) in degrees between the energy vector direction and the intended panning angle (FIG. 5A), the absolute difference in degrees between the velocity vector direction and the intended panning angle (FIG. 5B), and the absolute difference in degrees between the energy vector direction and the velocity vector direction (FIG. 5C) according to one or more embodiments described herein.

The results obtained confirm strong performance of the obtained panning functions, especially at the front of the array and also comparable performance to the best-so-far approaches at the remaining sectors. Fluctuations of the total emitted energy are virtually non-existent across the whole panning domain which makes the method comparable to the PCPP in this regard. The velocity-energy vector direction mismatch at the front of the array is greatly reduced around the troublesome point of 50° (FIGS. 5A-5C) and is also smaller at the other sectors of the array.

It will be appreciated that the optimization described herein is based on the calculated objective predictors of localization accuracy (described above), and not based on the improvement in terms of number of required operations/MACs. However, it should be emphasized that the gain optimization may be performed off-line and the results then stored in a look-up table. Application of the pre-computed gains for the use with head-tracking devices is an attractive approach since accounting for the new user's head orientation only makes it necessary to scale the multichannel signals by the resultant gain factors that are read from the look-up table. Besides that, no other processing of channels is necessary.

In terms of expected localization improvement, experimental results confirm that the panning methods and systems of the present disclosure outperform panning approaches, especially in the frontal and lateral directions.

Figure 6:
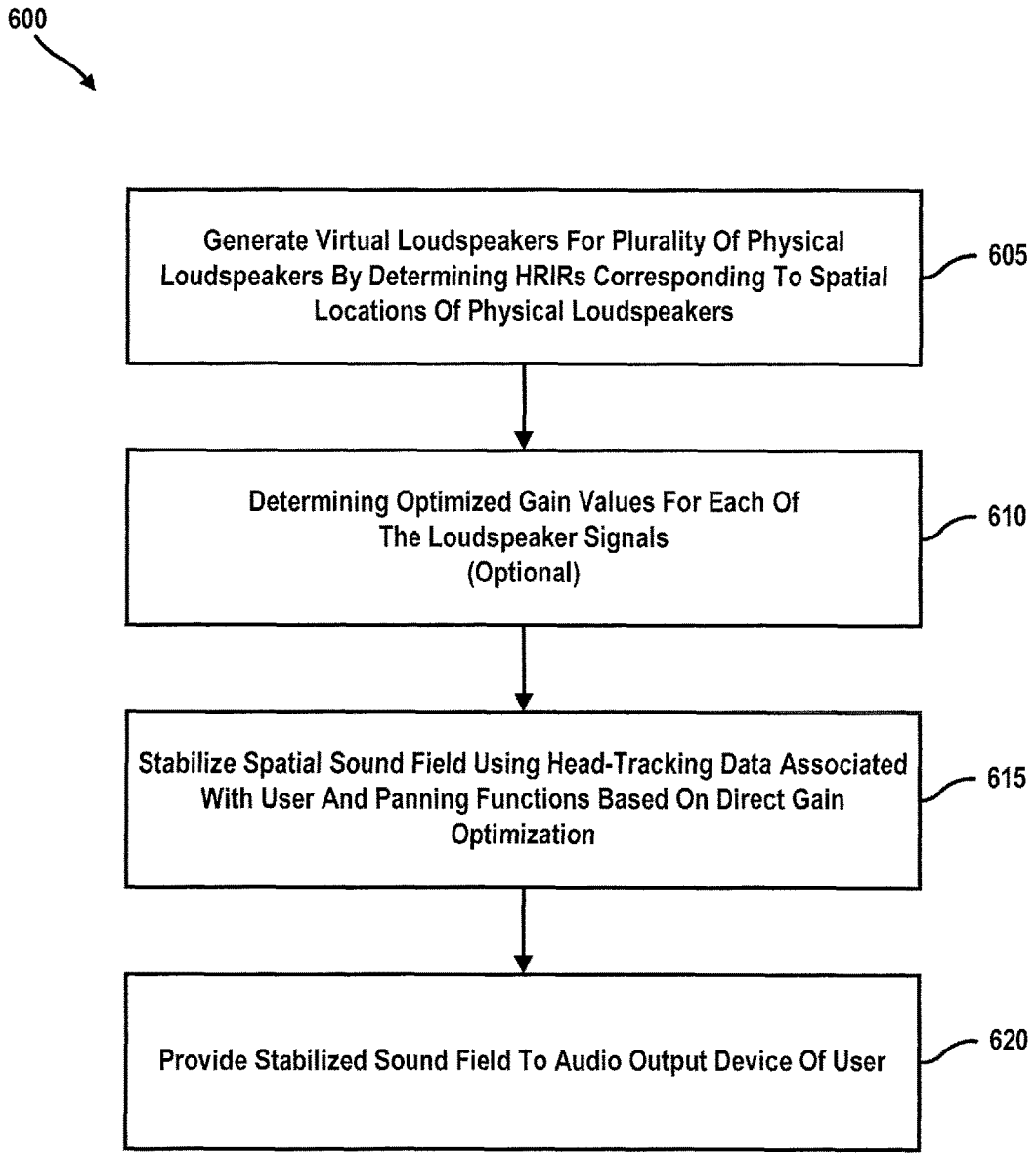
FIG. 6 is a flowchart illustrating an example method for updating a sound field in response to user movement according to one or more embodiments described herein.

FIG. 6 illustrates an example process (600) for updating a sound field in response to user movement, in accordance with one or more embodiments described herein.

At block 605, virtual loudspeakers may be generated for a corresponding plurality of physical loudspeakers. For example, the virtual loudspeakers may be generated by determining HRIRs corresponding to spatial locations of the physical loudspeakers.

At block 610, optimized gain values for each of the loudspeaker signals may be determined (e.g., in the manner described above). It should be noted that, in accordance with one or more embodiments described herein, block 610 may be optional in the example process (600) for updating a sound field.

At block 615, the spatial sound field for the user may be stabilized using head-tracking data associated with the user (e.g., associated with detected movement of the user) and panning functions based on direct gain optimization. For example, in accordance with at least one embodiment, the head-tracking data may be obtained from or based on information/indication provided by a headphone device of the user.

At block 620, the stabilized sound field may be provided to an audio output device (e.g., headphone device) of the user.

Figure 7:
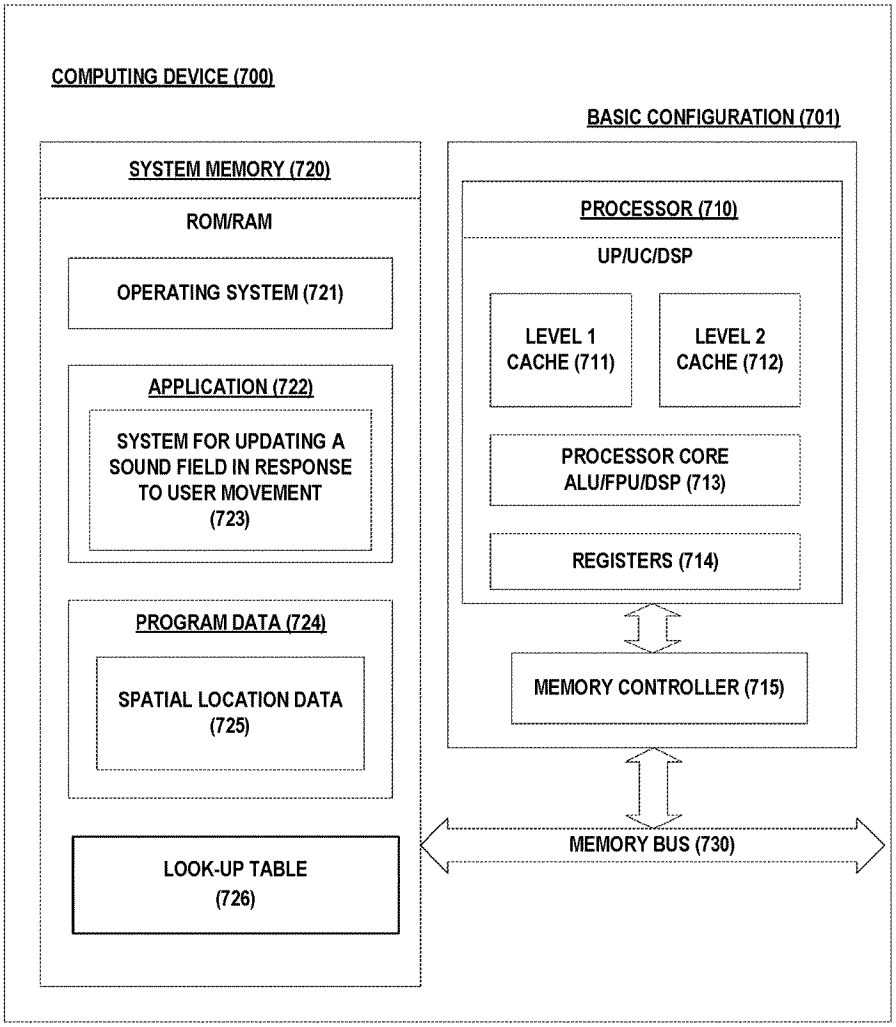
FIG. 7 is a block diagram illustrating an example computing device arranged for updating a sound field in response to user movement according to one or more embodiments described herein.

FIG. 7 is a high-level block diagram of an exemplary computer (700) that is arranged for updating a sound field in response to user movement, in accordance with one or more embodiments described herein. For example, in accordance with at least one embodiment, computer (700) may be configured to provide a dynamic binaural sound field rendering realized with the use of "virtual loudspeakers." Rather than loudspeaker signals being fed into the physical loudspeakers, the signals are instead filtered with left and right HRIRs corresponding to the spatial locations of these loudspeakers. The sums of the left and right ear signals are then fed into the audio output device (e.g., headphones) of the user. In a very basic configuration (701), the computing device (700) typically includes one or more processors (710) and system memory (720). A memory bus (730) can be used for communicating between the processor (710) and the system memory (720).

Depending on the desired configuration, the processor (710) can be of any type including but not limited to a microprocessor (μP), a microcontroller (μC), a digital signal processor (DSP), or any combination thereof. The processor (710) can include one more levels of caching, such as a level one cache (711) and a level two cache (712), a processor core (713), and registers (714). The processor core (713) can include an arithmetic logic unit (ALU), a floating point unit (FPU), a digital signal processing core (DSP Core), or any combination thereof. A memory controller (715) can also be used with the processor (710), or in some implementations the memory controller (715) can be an internal part of the processor (710).

Depending on the desired configuration, the system memory (720) can be of any type including but not limited to volatile memory (such as RAM), non-volatile memory (such as ROM, flash memory, etc.) or any combination thereof. System memory (720) typically includes an operating system (721), one or more applications (722), and program data (724). The application (722) may include a system for updating a sound field in response to user movement (723), which may be configured to provide a dynamic binaural sound field rendering realized with the use of "virtual loudspeakers," where the loudspeaker signals are filtered with left and right HRIRs corresponding to the spatial locations of physical loudspeakers, and the sums of the left and right ear signals are then fed into the audio output device (e.g., headphones) of the user, in accordance with one or more embodiments described herein.

Program Data (724) may include storing instructions that, when executed by the one or more processing devices, implement a system (723) and method for updating a sound field in response to user movement. Additionally, in accordance with at least one embodiment, program data (724) may include spatial location data (725), which may relate to data about physical locations of loudspeakers in a given setup. In accordance with at least some embodiments, the application (722) can be arranged to operate with program data (724) on an operating system (721).

The computing device (700) can have additional features or functionality, and additional interfaces to facilitate communications between the basic configuration (701) and any required devices and interfaces.

System memory (720) is an example of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 700. Any such computer storage media can be part of the device (700).

The computing device (700) can be implemented as a portion of a small-form factor portable (or mobile) electronic device such as a cell phone, a smart phone, a personal data assistant (PDA), a personal media player device, a tablet computer (tablet), a wireless web-watch device, a personal headset device, an application-specific device, or a hybrid device that include any of the above functions. The computing device (700) can also be implemented as a personal computer including both laptop computer and non-laptop computer configurations.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In accordance with at least one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers, as one or more programs running on one or more processors, as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of non-transitory signal bearing medium used to actually carry out the distribution. Examples of a non-transitory signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.)

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

The invention claimed is:

1. A method for updating a sound field, the method comprising:

generating virtual loudspeakers for a plurality of physical loudspeakers by determining a pair of Head Related Impulse Responses (HRIRs) corresponding to spatial locations of the plurality of physical loudspeakers;

stabilizing a spatial sound field including a set of virtual loudspeaker signal feeds using head-tracking data associated with a user and at least one panning function being applied to each of the virtual loudspeaker signal feeds, wherein the panning function is based on direct gain optimization, the direct gain optimization utilizes energy vectors and velocity vectors localization, the energy vectors and velocity vectors being calculated for a set of gain coefficients to satisfy at least one objective predictor of localization, each gain coefficient corresponds to one signal feed of the set of virtual loudspeaker signal feeds;

filtering the stabilized sound field resulting in a filtered stabilized sound field, the filtered stabilized sound field filtered with the pair of HRIRs corresponding to the spatial locations of the plurality of physical loudspeakers; and providing the filtered stabilized sound field to an audio output device associated with the user.

2. The method of claim 1, further comprising:

computing gains for each of the signals of the plurality of physical loudspeakers; and storing the computed gains in a look-up table.

3. The method of claim 2, further comprising:

determining modified gains for the loudspeaker signals based on rotated sound field calculations resulting from detected movement of the user.

4. The method of claim 3, wherein the modified gains for the loudspeaker signals are determined as a weighted sum of an original loudspeaker gains.

5. The method of claim 2, wherein the look-up table is psychoacoustically optimized for all panning angles based on objective criteria indicative of a quality of localization of sources.

6. The method of claim 1, wherein the audio output device of the user is a headphone device.

7. The method of claim 6, further comprising:

obtaining the head-tracking data associated with the user from the headphone device.

8. The method of claim 3, further comprising:

combining each modified gains with a corresponding pair of HRIRs; and sending the combined gains and HRIRs to the audio output device of the user, wherein the energy vectors and the velocity vectors are calculated for a given set of loudspeaker gains in a multichannel audio system.

9. A system for updating a sound field, the system comprising:

at least one processor; and a non-transitory computer-readable medium coupled to the at least one processor having instructions stored thereon that, when executed by the at least one processor, causes the at least one processor to:

generate virtual loudspeakers for a plurality of physical loudspeakers by determining a pair of Head Related Impulse Responses (HRIRs) corresponding to spatial locations of the plurality of physical loudspeakers;

stabilize a spatial sound field including a set of virtual loudspeaker signal feeds using head-tracking data associated with a user and at least one panning function being applied to each of the virtual loudspeaker signal feeds, wherein the panning function is based on direct gain optimization, the direct gain optimization utilizes energy vectors and velocity vectors localization, the energy vectors and velocity vectors being calculated for a set of gain coefficients to satisfy at least one objective predictor of localization, each gain coefficient corresponds to one signal feed of the set of virtual loudspeaker signal feeds;

filtering the stabilized sound field resulting in a filtered stabilized sound field, the filtered stabilized sound field filtered with the pair of HRIRs corresponding to the spatial locations of the plurality of physical loudspeakers; and provide the filtered stabilized sound field to an audio output device associated with the user.

10. The system of claim 9, wherein the at least one processor is further caused to:

compute gains for each of the signals of the plurality of physical loudspeakers; and store the computed gains in a look-up table.

11. The system of claim 10, wherein the at least one processor is further caused to:

determine modified gains for the loudspeaker signals based on rotated sound field calculations resulting from detected movement of the user.

12. The system of claim 11, wherein the modified gains for the loudspeaker signals are determined as a weighted sum of an original loudspeaker gains.

13. The system of claim 10, wherein the look-up table is psychoacoustically optimized for all panning angles based on objective criteria indicative of a quality of localization of sources.

14. The system of claim 9, wherein the audio output device of the user is a headphone device, and wherein the at least one processor is further caused to:

obtain the head-tracking data associated with the user from the headphone device.

15. The system of claim 11, wherein at least one processor is further caused to:

combine each modified gains with a corresponding pair of HRIRs; and send the combined gains and HRIRs to the audio output device of the user, wherein the energy vectors and velocity vectors are calculated for a given set of loudspeaker gains in a multichannel audio system.

16. A method of providing an audio signal including spatial information associated with a location of at least one virtual source in a sound field with respect to a position of a user, the method comprising:

obtaining a first audio signal including a plurality of signal feeds, each of the signal feeds corresponding to a respective one of a plurality of virtual loudspeakers located in the sound field;

obtaining an indication of user movement;

determining a plurality of panned signal feeds by applying, based on the indication of user movement, a panning function being applied to each of the signal feeds, the panning function utilizes a direct gain optimization function, the direct gain optimization utilizes energy vectors and velocity vectors localization, and the energy vectors and velocity vectors being calculated for a set of gain coefficients to satisfy at least one objective predictor of localization, each gain coefficient corresponds to one signal feed of the set of virtual loudspeaker signal feeds;

filtering the stabilized sound field resulting in a filtered stabilized sound field, the filtered stabilized sound field filtered with a pair of HRIRs corresponding to the spatial locations of the plurality of physical loudspeakers; and outputting to the user a second audio signal including the panned and filtered stabilized signal feeds.

17. The method of claim 16, wherein the second audio signal including the panned signal components is output through a headphone device of the user, and wherein the energy vectors and the velocity vectors are calculated for a given set of loudspeaker gains in a multichannel audio system.

18. The method of claim 17, wherein the indication of user movement is obtained from the headphone device of the user.

* * * * *